US012435470B2

(12) United States Patent
Grossmann et al.

(10) Patent No.: US 12,435,470 B2
(45) Date of Patent: Oct. 7, 2025

(54) METHOD FOR OPTIMIZING THE REFINING ENERGY DURING AN OPERATION OF REFINING OF A FIBER COMPOSITION

(71) Applicant: KADANT LAMORT, Vitry le Francois (FR)

(72) Inventors: Hugues Grossmann, Châlons-en-Champagne (FR); Alain Lascar, Saint Maurice (FR)

(73) Assignee: KADANT LAMORT, Vitry le Francois (FR)

( * ) Notice: Subject to any disclaimer, the term of this patent is extended or adjusted under 35 U.S.C. 154(b) by 0 days.

(21) Appl. No.: 18/848,860

(22) PCT Filed: May 30, 2023

(86) PCT No.: PCT/EP2023/064372
§ 371 (c)(1),
(2) Date: Sep. 19, 2024

(87) PCT Pub. No.: WO2023/232766
PCT Pub. Date: Dec. 7, 2023

(65) Prior Publication Data

US 2025/0207327 A1 Jun. 26, 2025

(30) Foreign Application Priority Data

May 30, 2022 (FR) ..... 2205115

(51) Int. Cl.
*D21D 1/20* (2006.01)

(52) U.S. Cl.
CPC ..... *D21D 1/20* (2013.01)

(58) Field of Classification Search
CPC ..... D21D 1/20
USPC ..... 162/61
See application file for complete search history.

(56) References Cited

FOREIGN PATENT DOCUMENTS

| | | | |
|---|---|---|---|
| EP | 3839134 | A1 | 6/2021 |
| WO | WO-86/06770 | A1 | 11/1986 |

OTHER PUBLICATIONS

Translation of WO2019/029958 2019-02-14.*
Search Report and Written Opinion in International Application No. PCT/EP2023/064372 dated Sep. 15, 2023, 11 pages.

* cited by examiner

*Primary Examiner* — Jacob T Minskey
(74) *Attorney, Agent, or Firm* — MARSHALL, GERSTEIN & BORUN LLP

(57) ABSTRACT

The present invention concerns a method of optimization of the refining energy supplied by a refiner to a fiber composition during a refining operation, the refiner comprising at least two refining disks separated from each other by an adjustable gap. The invention also relates to a refining system adapted to the implementation of such a method.

18 Claims, 4 Drawing Sheets

METHOD FOR OPTIMIZING THE REFINING ENERGY DURING AN OPERATION OF REFINING OF A FIBER COMPOSITION

TECHNICAL FIELD

The present invention relates to a method of optimization of the refining energy supplied by a refiner to a fiber composition during a refining operation, as well as a refining system adapted for the implementation of such a method.

BACKGROUND OF THE DISCLOSURE

In the technical field of paper manufacturing, it is known and current to refine the cellulosic fiber composition intended to subsequently form the paper or cardboard sheet, in order to modify certain properties of the sheet.

The refining comprises submitting the fibers to a mechanical treatment combining mechanical compression and shearing. It enables, particularly when it is performed in the presence of mineral fillers, to improve the rate of retention of these fillers in the paper sheet, and this without altering the mechanical properties of the paper, particularly its tensile or tearing strength.

The refining is often performed between two parallel refining disks facing each other, which are spaced apart from each other by an adjustable distance, usually called "gap". These two disks generally comprise a rotating disk (or rotor) and a fixed disk (stator). They are usually made of metal alloys, and comprise protrusions and grooves used to guide the fibrous composition when it is present between the disks.

The refining may be carried out by passage(s) of the fibrous composition between these disks. It may also be carried out by passage(s) through a series of pairs of disks (from 2 to 6 pairs of disks, for example), which may have the same gap or a decreasing gap.

EP 3 839 134 relates to a method of refining a fiber composition. This method involves measuring a vibration of the refiner during a refining operation, and adjusting the refiner gap according to the measured vibration value. This method does not control the refining energy.

WO 86/06770 relates to a method for controlling the preparation of mechanical pulp in a refiner process. According to this method, the pulp properties can be predicted due to the connection between the vibrations and the wear of the refiner discs.

One of the Main Concerns Remains the Control of the Energy Consumption of the Refiner Necessary for the Refining Operations.

During a refining operation, the physico-chemical characteristics of the fibrous composition vary according to the refining time and to the number of passages thereof between the disks or the series of disks of the refiner. These characteristics are particularly its consistency or density, and its rheology, that is, its flow properties according to the mechanical strain which is imposed thereto by the refiner.

The modification of the physico-chemical characteristics of the composition is due to the phenomena which are exerted on the fibers during the refining. The fibers indeed undergo compressive and shearing forces, which may cause their fibrillating. In this case, the fibers then have a ruffled appearance. Further, they may also be cut during the refining, so that their length may decrease along the passages through the refiner.

Thereby, in simplified fashion, it can be said that the more the refining advances, and the more the fibrous composition in the gap becomes fluid.

It can thus be understood that, if all the operating parameters of the refiner remain constant during the refining, particularly the space between the disks, the refining energy supplied by the refiner to the fibrous composition tends to decrease over time.

To illustrate the subject and have a concrete representation of the energy phenomena which are involved, a graph is shown in FIG. 1. It generally shows the variation of the refining energy, and of gap G, according to the number of passes Np (or cycles) of the fibrous composition between the refiner disks.

Generally, the refining energy, also called "specific energy", corresponds to the quantity of energy necessary to the refiner to refine one ton of fiber composition per hour. It is thus expressed in kilowatt-hour per ton of fibers (kWh/t).

A first curve E relates to the specific energy, measured in real time or discretely during the refining operation, which is the energy supplied by the refiner to the fiber composition during the refining operation.

A second curve Ei shows the desired specific energy, which corresponds to the optimal energy enabling to supply the fibers with a work adapted to their refining, during the refining period, with no energy loss.

A third curve Cs shows the refining energy set point, selected and set by the operator, to which the refiner must conform. Usually, the operator decreases the energy set point in decreasing stages during the refining operation.

Finally, gap G corresponds to the distance between the disks, and can usually be expressed in micrometers (μm).

According to this graph, it can be observed that the operator sets the energy set point Cs to a first set point value Cs1 (shown in dotted lines), at the beginning of the method. The specific energy will thus tend towards thus set point value, and if possible reach it. To keep a relatively constant specific energy E1, close to set point value Cs1, the gap decreases along the cycles according to a predefined sequence.

Indeed, as indicated previously, the refining of the fibrous composition causes a modification of its physical and chemical properties, particularly of its consistency and of its flow, that is, of its rheology. To keep the specific energy level at the level of the set point, it is thus necessary to adapt the gap to the variation of the rheology of the composition, and thus to draw the disks towards each other, which results in a decrease of gap G after the adoption of a new energy set point. It can be referred to the variation of curve G between time 0 and cycle 10.

To avoid for the disks to collide, the operator lowers the set point to a second set point value Cs2 at cycle 10. This causes an abrupt increase of the gap, since the disks then apply to the composition too significant a strain with respect to its rheology at this time, and are thus rapidly drawn away from each other to bring down the specific energy.

Between cycles 10 and 20, the modification of the rheology of the composition results in a regular decrease of gap G to keep a relatively constant specific energy E close to set point value Cs2.

This scheme carries on until the specific energy reaches a lower threshold value, at which the operator knows that the fibers have been sufficiently refined. The refining is then stopped.

This gradual decrease in the set point energy Cs, in the form of steps, thus enables to approach the desired specific energy Ei.

The set point energies Cs are empirically obtained, by trials-errors, by repeating the method a large number of times and by accordingly adapting the parameters, and this, for each type of fibrous composition.

Indeed, the desired energy curve Ei depends on a large number of parameters, among which the nature of the fibers, the consistency of the composition, and generally, the rheology of the composition.

Based on this analysis, two approaches can be envisaged.

A first approach, called conservative, comprises defining, prior to the starting of the refining, a stepped curve of energy set points with conservative parameters. This however implies a long refining time, since it is necessary to absolutely avoid for the disks to collide, and thus to provide a security margin by selecting the energy set point stages.

A second approach, called aggressive, comprises defining a stepped curve of energy set points so as to obtain a short refining time. This would however result in a collision of the disks for certain sets of input parameters, since the optimal movement law for the disks is unique for each set of input parameters.

These two approaches are thus not optimal.

Thus, to obtain an optimal movement law for the disks, a continuous manual monitoring is necessary. A major disadvantage is that this solution requires the presence of qualified operators, which generates high production costs, in addition to potentially decreasing the productivity when the operator has to spend time on this task rather than on another one which would require their expertise.

SUMMARY OF THE DISCLOSURE

An aim of the invention is to provide a method of optimization of the refining energy supplied by a refiner to a fiber composition during a refining operation, enabling to overcome the previous disadvantages.

The fiber composition comprises water and fibers, advantageously water and cellulosic fibers. It may also comprise mineral fillers. Those skilled in the art will be capable of adapting the mass ratio between the cellulosic fibers and the mineral fillers. They will also be capable of adapting the concentration of cellulosic fibers and of mineral fillers in the composition, particularly in water.

The invention particularly aims at providing such a method enabling to optimize the refining energy supplied by a refiner to a fiber composition, according to the physicochemical characteristics of said composition and to their variation during a refining operation and this, in automated fashion, without requiring the presence of an operator dedicated to the managing of the energy and/or to the setting of the gap during the refining operation.

In the method according to the invention, "energy", or "refining energy", means the specific energy of the refiner, which depends on the amount of fibers since it is expressed in KWh/ton of fibers. The method according to the invention allows optimizing the specific energy by continuously adapting the gap between the refiner disks.

For this purpose, the invention provides a method of optimization of the refining energy supplied by a refiner to a fiber composition during a refining operation, wherein the refiner comprises at least two refining disks separated from each other by an adjustable gap.

The method is mainly characterized in that it comprises the following steps:

setting an initial refining energy set point, measuring a vibration of the refiner, to obtain a corresponding vibration signal which depends on the gap, comparing at least one characteristic of the vibration signal with a determined maximum value and/or minimum value, so as to:

c1) if the characteristic of the vibration signal is lower than the maximum value, resume the method from step b), c2) if the characteristic of the vibration signal is higher than or equal to the maximum value, automatically decrease the initial refining energy set point down to a lower set point value, and automatically increase the gap so that the refining energy tends towards the lower set point value, and/or c3) if the characteristic of the vibration signal is higher than the minimum value, resume the method from step b), c4) if the characteristic of the vibration signal is lower than or equal to the minimum value, automatically increase the initial refining energy set point up to a higher set point value, and automatically decrease the gap so that the refining energy tends towards the higher set point value.

The invention is based on the control and the optimization of the refining energy (specific energy) used to refine a fibrous composition by using the measurement of the vibrations of the refiner.

The method according to the invention establishes for this purpose a direct link between the vibrations of the refiner and the specific energy.

This direct link enables to adapt the specific energy during a refining operation, to come as close as possible to the desired energy (curve Ei of FIG. 1). The general quantity of energy necessary to refine the fiber composition is thus decreased for a same refining duration. In other words, the refining time is decreased for a same quantity of energy used. The number of pairs of refining disks and/or the number of refining cycles can thus be decreased.

In further detail, as previously described, the more the refining advances, and the more the fibrous composition becomes fluid. Thus, to keep an efficient refining, that is, a specific energy value sufficient to efficiently refine the fibers, the latter being generally set on a set point, it is necessary to draw the disks (of a same pair) towards each other, which results in a decrease of the gap.

The drawing of the disks towards each other results in the latter starting resonating with each other. This phenomenon results in a modification of the vibration signal, particularly by an increase in the amplitude of the harmonics of a frequency characteristic of the body and of the disks of the refiner.

The invention uses this resonance phenomenon by regularly measuring in time a vibration of the refiner, preferably in real time (continuously), to detect the resonance. When the resonance is reached, the energy set point is lowered. The disks are then displaced to be drawn away from each other, so that the measured energy tend towards, or even reaches, the new lowered energy set point. One thus leaves the resonance area. It is a top-down regulation.

The invention also provides a bottom-up regulation. When the vibration of the refiner becomes too low, this means that the disks are too spaced apart to supply an optimal specific energy to the composition. The energy set point is then increased, which results in a drawing of the disks towards each other so that the measured energy tends to, or even reaches, the new increased set point. The resonance area is then approached.

The repeating of these steps during the refining results in a stepped and automated general decrease o the specific energy, and this, coming as close as possible to the desired energy (curve Ei of FIG. 1). The specific energy is thus optimized due to the measurements of the refiner vibrations. Of course, when a bottom-up regulation is performed, an increase of the specific energy can be locally observed, which results from the increase of the energy set point.

Further, the profile and the displacement speed of the disks between two consecutive energy set points, until they start resonating, depends on the nature of the fibrous composition, that is, on its physical properties, including its rheology, and on its chemical properties, that is, on the nature of the fibers. Now, the nature of the fibrous composition varies over time, and particularly between two consecutive energy set points. Accordingly, the method according to the invention enables to optimize the specific energy according to the physico-chemical properties of the fibrous composition and to their variation during the refining operation, based on the vibrations of the refiner, and this, accurately and automatically, without requiring the monitoring by an operator. The present invention does not require knowing or measuring the viscosity of the fibrous composition.

As will be seen in the rest of the present text, energy variation profiles according to the number of passes are thus obtained, which are different according to the nature of the refined fibrous compositions.

As an information, it is specified that a "vibration" designates a mechanical oscillation movement of the molecules around a stable position of equilibrium. The measurement of the vibrations is performed by transforming the mechanical oscillation into an electrical oscillation by means of transducers, such as electromagnetic, electrodynamic, electrostatic, or also piezoelectric sensors (advantageously accelerometers or microphones). One or a plurality of sensors may be used. In case of a plurality of sensors, these are advantageously sensors of the same type, for example, accelerometers.

Since a sound is a mechanical vibration of a fluid, the term "vibration" encompasses not only waves which propagate in the elements forming the refiner (solid medium), but also waves which propagate in air around the refiner (fluid medium), that is, "sound waves", whether they belong to the spectrum of audible frequencies, of infrasounds, or of ultrasounds According to the invention, monitoring the vibrations allows optimizing the specific energy as the refiner is always at its highest energy limit possible i.e. its highest whistling sound.

According to other aspects, the method according to the invention exhibits the different following characteristics taken alone or according to their technically possible combinations:

- the method is repeated at least once from step b) after the carrying out of step c2) or of step c4), the initial refining energy set point being replaced with the lower or upper set point, respectively;
- the characteristic of the vibration signal comprises an acceleration of the refiner;
- the acceleration is measured by calculating an average in real time of a parameterizable number of acceleration values measured within a time interval in the range preferably from 0.5 second to 5 seconds, more preferably from 1 second to 3 seconds;
- the parameterizable number of acceleration values is in the range from 10 to 500, preferably from 50 to 300, more preferably from 100 to 300;
- the lower set point of step c2) or the upper set point of step c4) is kept constant for a time interval of at least 5 seconds, preferably for at least 10 seconds, more preferably for at least 20 seconds (advantageously less than 60 minutes), whatever the vibration measured during said time interval.

The invention relies on the acceleration of the refiner.

The acceleration is preferably measured by calculating an average in real time of a parameterizable number of acceleration values measured within a time interval. Accordingly, measuring the acceleration does not rely on a number of events above a maximum value or below a minimum value.

The invention also relates to a refining system for the implementation of the previously-described method. It thus is a refining system for the optimization of the refining energy supplied by said refining system to a fiber composition during a refining operation.

The system is mainly characterized in that it comprises:

- a refiner provided with at least two refining disks separated from each other by an adjustable gap,
- a vibration sensor configured to measure a vibration of the refiner, and to output a corresponding vibration signal which depends on the gap,
- a control system configured to receive the vibration signal of the vibration sensor, to compare at least one characteristic of the vibration signal with a determined maximum value or minimum value, and to control the refiner, according to the previously-described method.

According to other aspects, the system according to the invention has the different following characteristics taken alone or according to their technically possible combinations:

- the vibration sensor comprises an accelerometer (or a microphone), and the characteristic of the vibration signal comprises an acceleration of the refiner measured by said accelerometer (or said microphone);
- the control system is configured to measure the acceleration by calculating the average in real time of a parameterizable number of acceleration values measured by the accelerometer (or by the microphone) within a time interval in the range from 0.5 second to 5 seconds, preferably from 1 second to 3 seconds;
- the parameterizable number of acceleration values is in the range from 10 to 500, preferably from 50 to 300, more preferably from 100 to 300;
- the control system is configured to keep constant the lower set point of step c2) or the upper set point of step c4) for a time interval of at least 5 seconds, preferably for at least 10 seconds, more preferably for at least 20 seconds (advantageously less than 60 minutes), whatever the vibration measured during said time interval.

BRIEF DESCRIPTION OF THE DRAWINGS

Other advantages and characteristics of the invention will occur upon reading of the following description given as an illustrative and non-limiting example, in relation with the following accompanying drawings.

DETAILED DESCRIPTION

Figure 1:
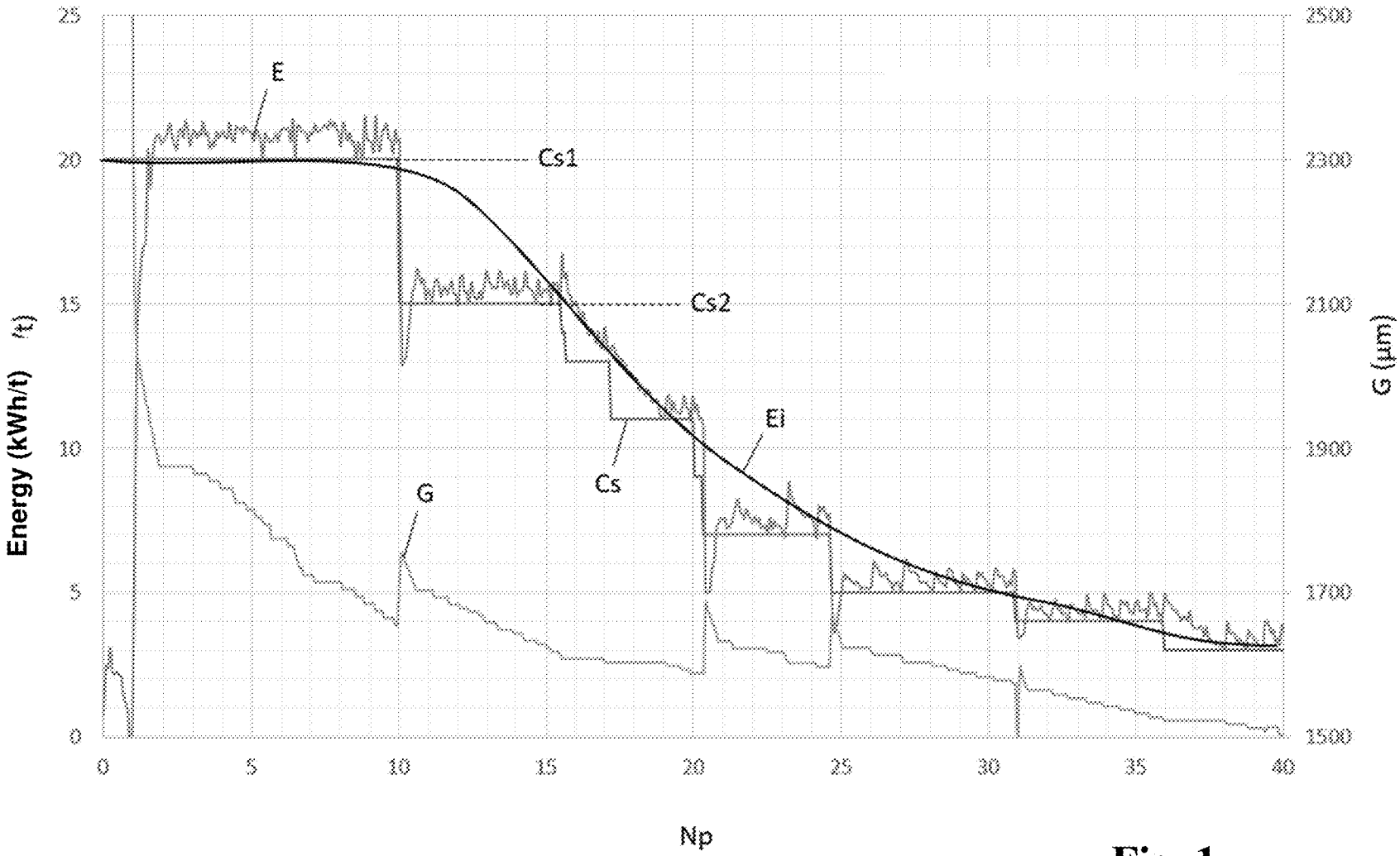
FIG. 1 is a graph according to the state of the art, which illustrates the variation of the specific energy and of the gap of a pair of disks of a refiner according to the number of refining cycles.

The invention concerns a method of optimization of the refining energy supplied by a refiner to a fiber composition during a refining operation, as well as a refining system adapted to the implementation of such a method.

The refining system comprises a refiner.

The refiner is provided with at least two refining disks separated from each other by an adjustable gap, This means that the disks are mobile with respect to each other, and may be drawn towards or away from each other. Generally, in a pair of disks, a single one of the disks may be mobile (rotor) while the other remains fixed (stator). The center of each disk is on the same axis as the shaft of the refiner. One of the disks is generally located on an opening part of the refiner i.e. a door, which allows an easy rearranging or changing of the disks.

It is possible to provide several pairs of disks, arranged in series or in parallel, according to the desired type of refining. Those skilled in the art will know how to optimize the number of disks and their arrangement in order to obtain the desired refining performance.

The refining system also comprises at least one vibration sensor, configured to measure a vibration of the refiner, and to output a vibration signal of the refiner.

For this purpose, one or a plurality of vibration sensors may be used, to make the vibration measurement more accurate. The sensor(s) may be arranged at different locations of the refiner, for example, on the refiner body and/or on the refiner motor. According to a particular embodiment, the refiner does not comprise any vibration sensor on the refining discs.

According to another particular embodiment, the refiner does not comprise any vibration sensor on the refiner door. In general, a sensor on the refiner door allows detecting vibrations that are parallel to the refiner shaft. According to this embodiment, the vibration sensor is not along the shaft.

According to a preferred embodiment, the refiner comprises a vibration sensor on its main body. The vibration sensor is preferably located such as it allows detecting vibrations that are perpendicular to the shaft of the refiner.

Preferably, at least two vibration sensors are used, a first sensor of which is positioned on the refiner body and a second sensor of which is positioned on the refiner motor.

According to a preferred embodiment, the vibration sensor comprises an accelerometer (or a microphone), configured to measure an acceleration of the refiner and output an electric signal characteristic of said acceleration of the refiner.

Alternatively, the vibration sensor may comprise a microphone, configured to measure a sound vibration resulting from the vibration of the refiner, and to output an electric signal characteristic of said sound vibration.

The refining system also comprises a control system, configured to control at least one of the elements of the refiner, including at least one of the refining disks.

The control system is configured to receive as an input the vibration signal of the vibration sensor, to compare at least one characteristic of the vibration signal with a determined maximum value or minimum value, and to control one at least of the disks to accordingly modify the gap as explained in further detail in the rest of the present text.

The refining system preferably comprises at least one calculation device, configured to calculate a refining energy, that is, a specific energy. The calculation device is connected to a plurality of sensors, from which it receives the data used for the calculation of the specific energy, for example, the flow rate of the fibrous composition, the rotation speed of the motor and of the disks, or also the gap.

The calculation system may calculate the specific energy in real time, that is, continuously, or discretely at determined times.

The calculation device may be integrated to the control system, or distinct therefrom.

The refining system also comprises a memory where data relative to the operation of the refining system can be stored. These data particularly comprise one or a plurality of specific energy set points. They may be recorded by the manufacturer at the manufacturing of the system and/or by an operator before or during a refining operation.

The memory may be integrated to the control system, or distinct therefrom.

The method of optimization of the refining energy according to the invention will now be described in reference with FIGS. 2, 3, and 4. This method is based on the implementation of the refining system which has just been described.

It is started by starting the refining system, which is fed with a flow of fibrous composition.

Preferably, the refining energy is measured from as soon as the beginning of the refining and all along the refining operation. This measurement is performed by the calculation device.

The flow of fibrous composition as well as the rotation speed of the motor and of the disks of the refiner are preferably kept constant all along the refining operation. Apart from obvious convenience and industrial constraint reasons, this enables to vary a small number of parameters, and thus to better control the variation of the specific energy over time.

At a step a), an initial refining energy (or initial specific energy) set point, noted Cs1, is set.

A step b) comprises measuring a vibration of the refiner, to obtain a corresponding vibration signal. The vibration signal depends on the gap, in that it is all the stronger as the disks are close to each other. In practice, this measurement variation is performed by the vibration sensor, which receives as an input the refiner vibrations, and outputs a corresponding vibration signal. The vibration signal is then transmitted to the control system.

The vibration signal can then be processed by a system for processing the signal provided for this purpose. The signal for example is filtered over a given frequency interval.

The control system receives as an input the vibration signal. At a step c), it compares at least one characteristic Cq of said vibration signal with a determined maximum value $V_{max}$ or minimum value $V_{min}$.

Figure 2:
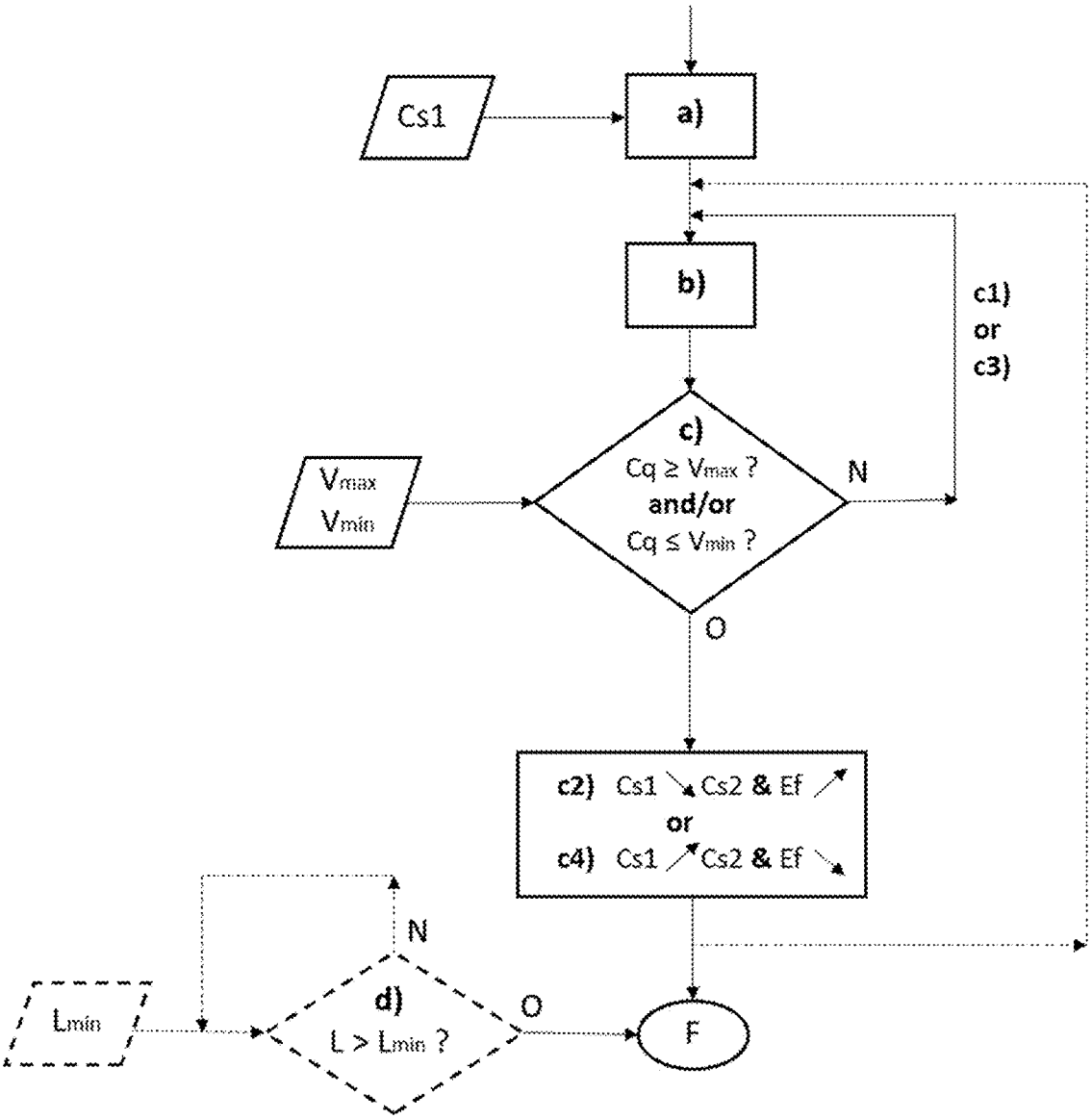
FIG. 2 shows a flowchart which illustrates the different steps of the method of optimization of the refining energy according to the invention.

In the flowchart of FIG. 2, these conditions are noted: "Cq $\geq V_{max}$?" and "Cq$\leq V_{min}$?".

In practice, the maximum and minimum values $V_{max}$ and $V_{min}$ depend on the settings of the refining system. They are thus empirically determined by the operator during different refining trials, and recorded by the latter in the memory of the refining system. The operator can modify them before or during a refining operation.

At the end of the comparison, if the characteristic Cq of the vibration signal is lower than maximum value $V_{max}$, or higher than minimum value $V_{min}$, then the previous condition is not fulfilled (N). The method is then repeated from measurement step b). This alternative is called c1) or c3) in the flowchart of FIG. 2.

Conversely, if the characteristic Cq of the vibration signal is higher than or equal to maximum value $V_{max}$, or lower than or equal to minimum value $V_{min}$, then the previous condition is fulfilled (O).

Condition $Cq \geq V_{max}$ fulfilled means that the refiner has started resonating and that the disks are very close to each other. The control system then automatically decreases the specific energy set point Cs1 down to a lower set point value Cs2. For the specific energy to tend to the lower set point value and then to stabilize around this value, the control system automatically controls the disks to draw them apart, thus increasing gap Ef. Thereby, the refiner leaves the resonance state. This alternative is called c2) in the flowchart of FIG. 2.

Incidentally, steps c) and c2) enable to avoid for the refiner disks to collide, and this, whatever the energy set point in force. This implies that it is possible to select a very high initial energy set point to maximize the efficiency of the refining, without fearing an incident caused by a collision of the disks.

Condition $Cq \leq V_{min}$ fulfilled means that the vibration is very low, which suggests that the disks are too distant from each other to provide the energy sufficient to efficiently refine the fibers. The control system then automatically increases the specific energy set point Cs1 up to a higher set point value Cs2. For the specific energy to tend to the higher set point value and then to stabilize around this value, the control system automatically controls the disks to bring them closer to each other, thus decreasing gap Ef. This alternative is called c4) in the flowchart of FIG. 2.

According to a preferred embodiment, the characteristic Cq of the vibration signal comprises an acceleration of the refiner. Such an acceleration is usually expressed in g, where 1*g* is equivalent to approximately 9.82 $m/s^2$. Then, comparison c) as well as alternatives c2) and c4) are carried out with an acceleration value, by comparison of said acceleration value with maximum and minimum acceleration values $V_{max}$ and $V_{min}$.

The acceleration used may be a rms. value of the amplitude of the vibration signal filtered over a determined frequency range. The determined frequency range may for example be in the range from 4 kHz to 10 KHz.

The acceleration is preferably measured by calculating the average in real time of a parameterizable number of acceleration values measured within a given time interval. It is then spoken of a mobile or sliding average. This means that the average is permanently modified by the continuous taking into account of new acceleration values and the rejection of old acceleration values, which are used for its calculation.

The time interval within which the acceleration average is calculated is advantageously in the range from 0.5 second to 5 seconds, preferably from 1 second to 3 seconds.

Further, the parameterizable number of acceleration values is advantageously in the range from 10 to 500, preferably from 50 to 300, more preferably from 100 to 300.

At the end of step c2) or of step c4), the method is preferably repeated at least once from step b) to optimize the specific energy all along the refining operation. In this case, the new specific energy set point Cs2 is likely to be automatically modified into a lower or higher set point Cs3, according to the result of comparison step c), and so on along the successive iterations of the method.

Preferably, the lower or higher set point Cs2 resulting from step c2) or from step c4), respectively, is kept constant for a time interval of at least 5 seconds, preferably for at least 10 seconds, more preferably for at least 20 seconds (advantageously less than 60 minutes), whatever the vibration measured during said time interval. This enables to properly stabilize the system energy at the new set point value, and to avoid any energy loss.

Optionally, step c) (that is, sub-steps c2) and c4) may be followed by a step d) according to which the measurement device performs a measurement of the average length of the fibers of the fibrous composition. It may be a number, weight, or length average, according to what suits the operator.

If the average length L of the fibers is greater than a minimum length Lmin, the refining continues. If, on the contrary, said average length of the fibers is smaller than or equal to minimum length Lmin, the refining is stopped.

Figure 3:
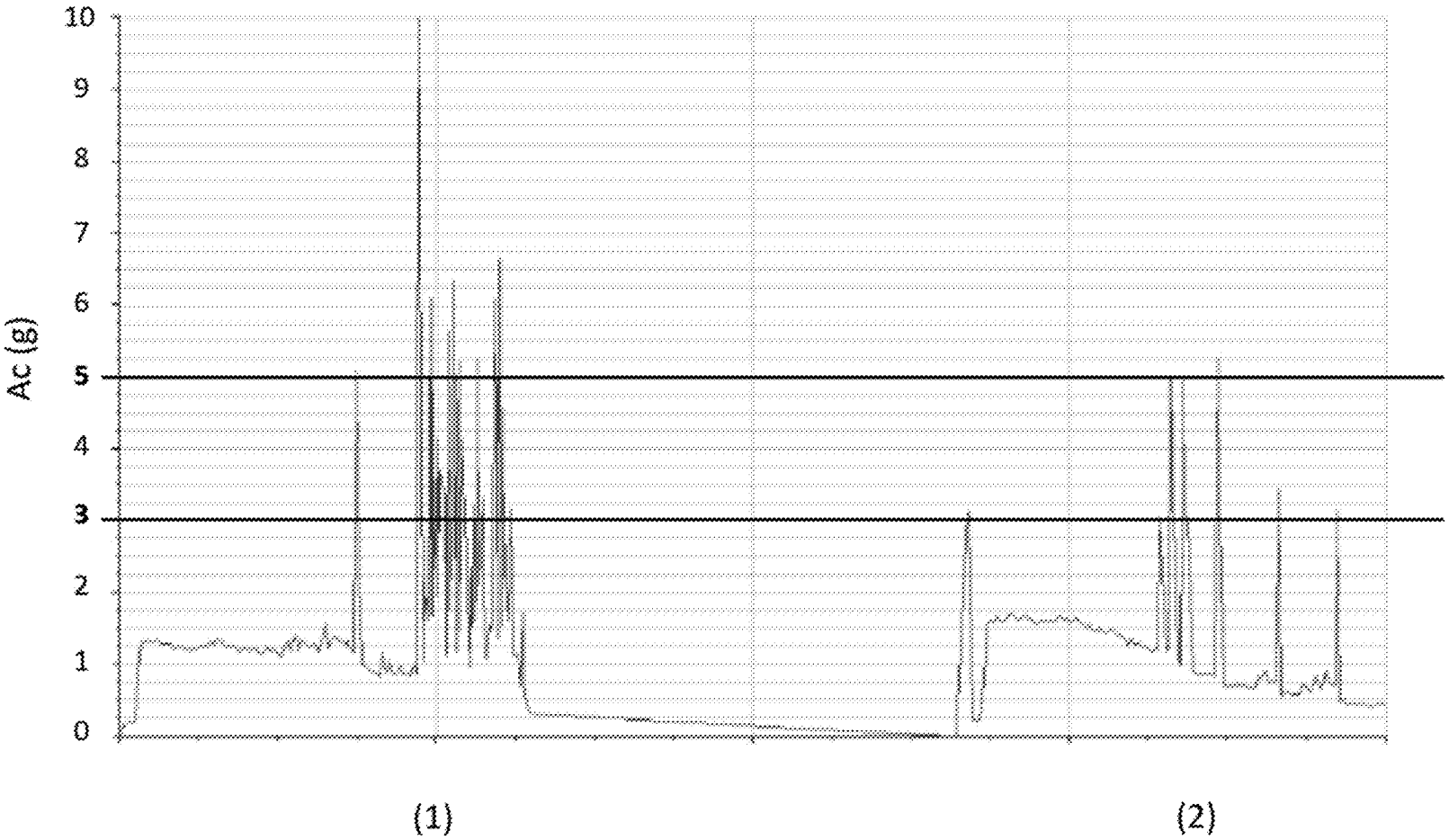
FIG. 3 shows a signal of measurement of the acceleration of the refiner during a refining operation.

FIG. 3 illustrates a graph showing a vibration signal measured by the sensor and transmitted by the latter to the control system. The characteristic of the vibration signal which is measured and then compared here is an acceleration, noted Ac (expressed in g), which is plotted in ordinates.

The left-hand signal (I) relates to a first reactor, for which a maximum acceleration value is set to 5 g (1 g=9.80665 $m/s^2$). The calculation device determines in real time the average of the acceleration based on the amplitude of the signal. When this average is greater than or equal to maximum value 5 g, the control system lowers the set point value down to a new lower set point value (for example, 4.5 g), and sends a control order to the disks to draw them away from each other, thus increasing the gap, and then decreasing the specific energy. The control system adjusts the gap so that the specific energy tends towards, or even reaches, the new lower set point value. The specific energy is thus controlled in top-down fashion.

The right-hand signal (2) relates to a second reactor, for which a maximum acceleration value is set to 3 g. Similarly to the left-hand reactor, when the measured average acceleration is higher than or equal to maximum value 3 g, the control system lowers the set point value down to a new lower set point value, and controls the disks to increase the gap.

It is also possible to provide for value 3 g to represent a minimum acceleration value for the left-hand reactor (1), independently from or in combination with maximum value 5 g. In this case, when the measured average acceleration is smaller than or equal to minimum value 3 g, the control system increases the set point value to a new higher set point value (for example, 3.5 g) and sends a control order to the disks to bring them closer to each other, thus decreasing the gap, and then increasing the specific energy. The control system adjusts the gap so that the specific energy tends to, or even reaches, the new higher set point value. The specific energy is thus controlled in bottom-up fashion.

Respectively, it is of course possible to provide for value 5 g to represent a maximum acceleration value for the right-hand reactor (2), independently from or in combination with minimum value 3 g. The operating principle is the same as the foregoing.

When both a minimum value 3 g and a maximum value 5 g are set, the measured average acceleration is compared with each of these two limiting values, and the specific energy is increased or decreased according to its value. The specific energy is thus controlled from in top-down and in bottom-up fashion.

Figure 4:
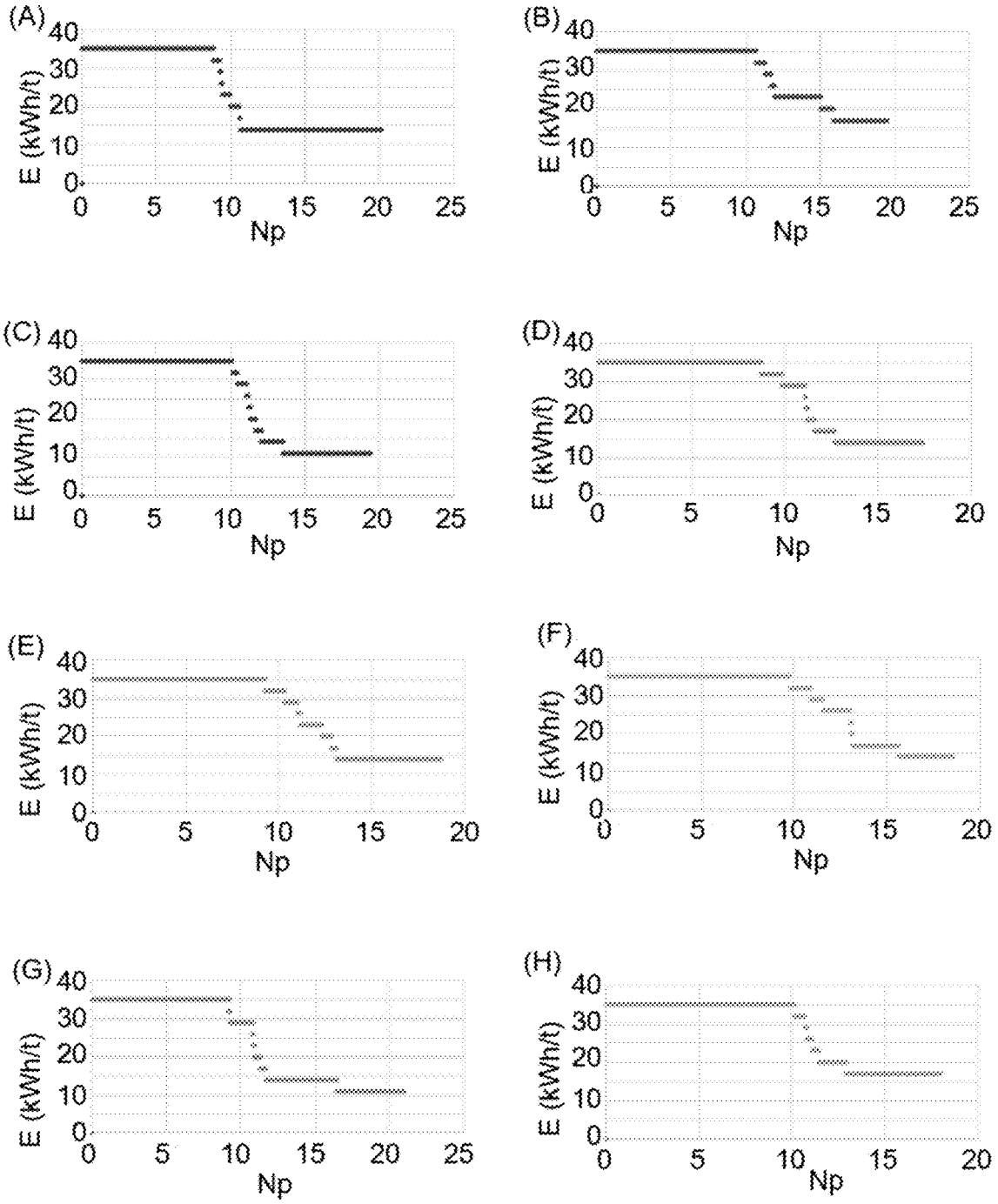
FIG. 4 shows a plurality of graphs A to F according to the invention, which illustrate the variation of the refining energy according to the number of refining cycles, for a plurality of operations of refining of different fibrous compositions.

FIG. 4 shows 8 graphs bearing references (A), (B), (C), (D), (E), (F), (G), and (H), which illustrate the variation of specific energy E according to the number of passes Np in the refiner, for different fibrous compositions.

What is important to notice is that these graphs all have a relatively similar profile, that is, a staged energy decrease, along the refining of the composition. However, the number of stages, their duration, and their respective energy differs from one graph to the other, and thus from one fibrous composition to the other.

For example, graph (A) comprises 8 stages, to be compared with 7 stages only for graph (B). Similarly, graph (G) comprises 9 stages, to be compared with 7 stages only for graph (H).

Further, and still as an example, the 23-kWh/t stage of graph (A) lasts for approximately 1 pass, to be compared with approximately 3 passes for that of graph (B). Similarly, the 17-kWh/t stage of graph (G) lasts for approximately 1 pass, to be compared with approximately 5 passes for that of graph (H). The 17-kWh/t stage is, besides, the last stage of graph (H) since the fibers have then reached their minimum size, conversely to graph (G) which further comprises the 14-kWh/t and then 11-kWh/t stages, necessary to complete the refining.

This can be explained as follows. The compositions of graphs (A) to (H) differ by their physico-chemical properties, particularly by the nature of the fibers, their relative quantity in the composition, their length distribution, or also by the consistency of the composition, and by the presence and the nature of fillers incorporated in the composition.

These property differences have an impact on the rheology of the compositions, that is, on their flow properties according to the strain applied during the refining.

Further, the more the refining advances, the more the fibers are shortened and sheared, so that the previous properties are modified, as well as the rheology.

Accordingly, the variation of the specific energy measured over time differs from one composition to the other, thus resulting in a regulation of said energy by the control system according to the invention, itself also different. In practice, the variation profile of the gap during the refining varies according to the composition to be refined.

The method of the invention takes into account the variation of the physico-chemical properties of the composition, and automatically adjusts, accordingly, the specific energy at closest to the optimal energy.

Thus, the method of the invention automatically adjusts and optimizes the specific energy according to the physico-chemical properties of the composition to be refined, by using the vibration of the refiner as a measurement element.

The invention claimed is:

1. A method of optimization of the refining energy supplied by a refiner to a fiber composition during a refining operation, the refiner comprising at least two refining disks separated from each other by an adjustable gap, said method comprising the following steps:

a) setting an initial refining energy set point, b) measuring a vibration of the refiner, to obtain a corresponding vibration signal which depends on the gap, c) comparing at least one characteristic of the vibration signal with a determined maximum value and a determined minimum value so as to:

c1) if the characteristic of the vibration signal is lower than the maximum value and higher than the minimum value, resume the method from step b), c2) if the characteristic of the vibration signal is higher than or equal to the maximum value, automatically decrease the initial refining energy set point down to a lower set point value, and automatically increase the gap so that the refining energy tends towards the lower set point value, and c3) if the characteristic of the vibration signal is lower than or equal to the minimum value, automatically increase the initial refining energy set point up to a higher set point value, and automatically decrease the gap so that the refining energy tends towards the higher set point value, wherein the lower set point of step c2) or the higher set point of step c3) is kept constant for a time interval of at least 5 seconds, whatever the vibration measured during said time interval, and wherein the characteristic of the vibration signal comprises an acceleration of the refiner.

2. A method according to claim 1, wherein the method is repeated at least once from step b) after the carrying out of step c2) or of step c3), the initial refining energy set point being replaced with the lower or higher set point, respectively.

3. A method according to claim 1, wherein the acceleration is measured by calculating an average in real time of a parameterizable number of acceleration values measured within a time interval in the range from 0.5 second to 5 seconds.

4. A method according to claim 3, wherein the parameterizable number of acceleration values is in the range from 10 to 500.

5. A method according to claim 1, wherein:

the method is repeated at least once from step b) after the carrying out of step c2) or of step c3), the initial refining energy set point being replaced with the lower or upper set point, respectively;

the characteristic of the vibration signal comprises an acceleration of the refiner;

the acceleration is measured by calculating an average in real time of a parameterizable number of acceleration values measured within a time interval in the range from 0.5 second to 5 seconds;

the parameterizable number of acceleration values is in the range from 10 to 500;

the lower set point of step c2) or the higher set point of step c3) is kept constant for a time interval of at least 5 seconds, whatever the vibration measured during said time interval.

6. A method according to claim 1, wherein the lower set point of step c2) or the higher set point of step c3) is kept constant for a time interval of at least 10 seconds.

7. A method according to claim 1, wherein the lower set point of step c2) or the higher set point of step c3) is kept constant for a time interval of at least 20 seconds.

8. A method according to claim 1, wherein the acceleration is measured by calculating an average in real time of a parameterizable number of acceleration values measured within a time interval in the range from 1 second to 3 seconds.

9. A method according to claim 3, wherein the parameterizable number of acceleration values is in the range from 50 to 300.

10. A method according to claim 3, wherein the parameterizable number of acceleration values is in the range from 100 to 300.

11. A refining system for the optimization of the refining energy supplied by said refining system to a fiber composition during a refining operation, comprising:

a refiner provided with at least two refining disks separated from each other by an adjustable gap, a vibration sensor configured to measure a vibration of the refiner, and to output a corresponding vibration signal which depends on the gap, a control system configured to receive the vibration signal of the vibration sensor, to compare at least one characteristic of the vibration signal with a determined maximum value or minimum value, and to control the refiner, according to the method of claim 1, wherein the vibration sensor comprises an accelerometer or a microphone, and the characteristic of the vibration signal comprises an acceleration of the refiner measured by said accelerometer or said microphone, wherein the control system is configured to keep constant the lower set point of step c2) or the higher set point of step c3) for a time interval of at least 5 seconds, whatever the vibration measured during said time interval.

12. A refining system according to claim 11, wherein the control system is configured to measure the acceleration by calculating the average in real time of a parameterizable number of acceleration values measured by the accelerometer or the microphone within a time interval in the range from 0.5 second to 5 seconds.

13. A refining system according to claim 12, wherein the parameterizable number of acceleration values is in the range from 10 to 500.

14. A refining system according to claim 11, wherein the control system is configured to keep constant the lower set point of step c2) or the higher set point of step c3) for a time interval of at least 10 seconds.

15. A refining system according to claim 11, wherein the control system is configured to keep constant the lower set point of step c2) or the higher set point of step c3) for a time interval of at least 20 seconds.

16. A refining system according to claim 11, wherein the control system is configured to measure the acceleration by calculating the average in real time of a parameterizable number of acceleration values measured by the accelerometer or the microphone within a time interval in the range from 1 second to 3 seconds.

17. A refining system according to claim 12, wherein the parameterizable number of acceleration values is in the range from 50 to 300.

18. A refining system according to claim 12, wherein the parameterizable number of acceleration values is in the range from 100 to 300.

* * * * *